US005941341A

United States Patent [19]

Gillis et al.

[11] Patent Number: 5,941,341

[45] Date of Patent: Aug. 24, 1999

[54] MOBILE LADDER STAND

[76] Inventors: Donald G. Gillis, 750 Pinecrest Dr., Prospect Heights, Ill. 60070; Daniel Johnson, 100 S. Hancock, Freeport, Ill. 61032

[21] Appl. No.: 08/851,204

[22] Filed: May 5, 1997

Related U.S. Application Data

[63] Continuation of application No. 08/115,881, Sep. 1, 1993.

[51] Int. Cl.[6] ..... E06C 5/00

[52] U.S. Cl. ..... 182/17; 182/15

[58] Field of Search ..... 182/12–17, 127; 280/47.16

[56] References Cited

U.S. PATENT DOCUMENTS

| | | | |
|---|---|---|---|
| 321,342 | 6/1885 | Covert | 182/16 |
| 1,239,498 | 9/1917 | Madigan . | |
| 1,355,173 | 10/1970 | Shadel | 280/43.14 |
| 1,360,208 | 11/1920 | Gamble | 182/174 |
| 2,216,972 | 10/1940 | Gibson | 214/65 |
| 2,585,763 | 2/1952 | Gasner | 288/44 |
| 2,624,590 | 1/1953 | Tilton | 182/17 |
| 3,155,190 | 11/1964 | Borgman | 182/15 |
| 3,291,254 | 12/1966 | Mihalik | 182/15 |
| 3,684,055 | 8/1972 | Rice | 182/17 |
| 3,685,851 | 8/1972 | Berry | 280/43.22 |
| 4,063,616 | 12/1977 | Gutierrez | 182/17 |
| 4,793,624 | 12/1988 | Mace | 280/47.16 |

FOREIGN PATENT DOCUMENTS

| | | | |
|---|---|---|---|
| 1021831 | 11/1977 | Canada | 182/17 |
| 2002301 | 8/1977 | United Kingdom . | |

*Primary Examiner*—Alvin Chin-Shue
*Attorney, Agent, or Firm*—Robert E. Browne; Mark R. Galis

[57] ABSTRACT

A safety ladder stand comprising a generally rectangular base having a front and rear and a center beam, a plurality of stair treads extending upward from the front of said base and means for supporting said stair treads secured to said base, front wheels mounted at the front of said base and beneath the top of said stair treads; center wheels mounted on said center beam of said base, and rear wheels mounted at the rear of said base, and a set of feet mounted on the front of said base; wherein said ladder stand has an activated position wherein said front and center wheel sets are in contact with the ground to enable said ladder stand to roll and said rear wheels and front support feet are not in contact with the ground, as well as a deactivated position wherein the front and center wheel sets are not in contact with the ground and said rear wheels and front support feet are in contact with the ground to prevent said ladder stand from being rolled; and means for moving said ladder stand from said deactivated position to said activated position.

7 Claims, 3 Drawing Sheets

FIG. 3
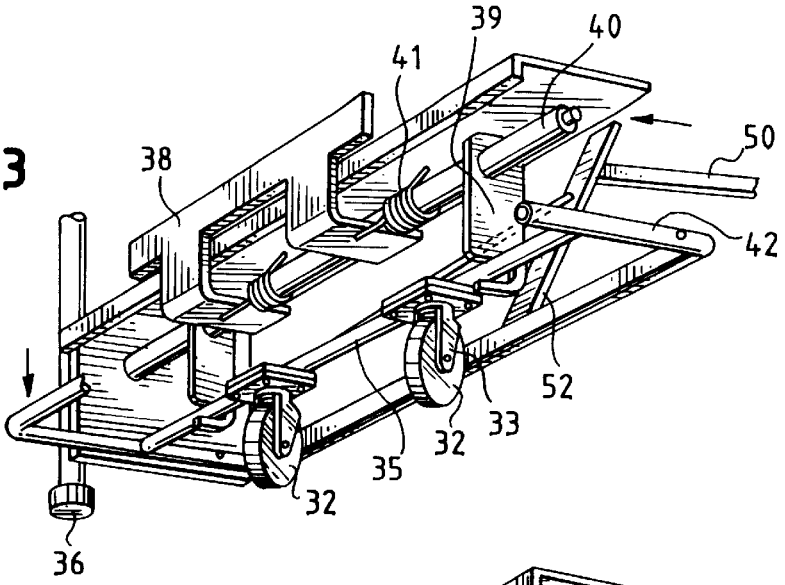
FIG. 4
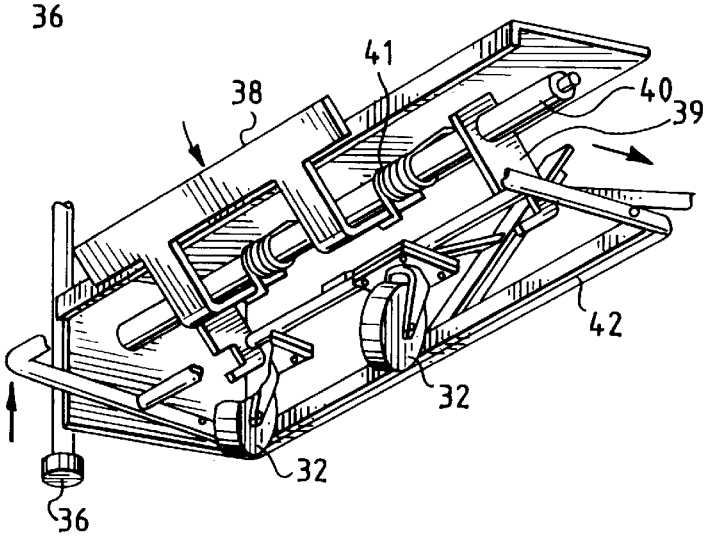
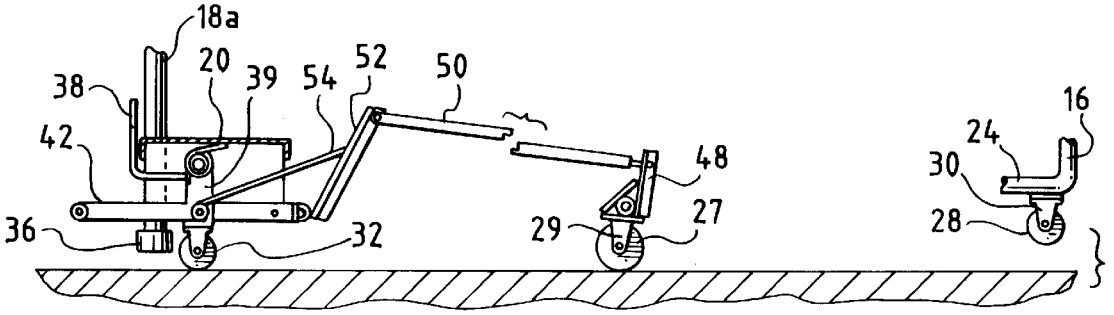
FIG. 5

MOBILE LADDER STAND

This application is a continuation of application Ser. No. 08/115,881, filed Sep. 1, 1993, pending.

BACKGROUND OF THE INVENTION

This invention relates to mobile ladder stands and an improved design which allows such a ladder stand to be used in small spaces where mobility of larger ladders is restricted. Mobile ladder stands are generally known in the industry and are used, for example, by workers and others who need to reach products or materials stored on shelves in stores and warehouses. Such mobile ladder stands also generally incorporate a rolling/locking mechanism so that the ladder apparatus can be moved easily to different locations in the building when such a mechanism is activated. The rolling/locking mechanism is deactivated when the mobile ladder stand is to be used, i.e., when the user climbs on to it. The deactivation of the rolling/locking mechanism stabilizes the mobile ladder stand in a fixed position, allowing for safer, steadier use.

Large mobile ladder stands with rolling/locking mechanisms presently available are awkward to maneuver in small spaces such as aisles in stores or warehouses. This lack of maneuverability is due to the fact that the length of the base must be increased to accommodate a taller ladder stand. Since such ladder stands are generally supported by wheel sets on all four corners of the base, a longer base makes turning of the stand difficult. It is the object of this invention to present an improved mobile ladder stand which is more mobile and more easily maneuvered than other available mobile ladder stands.

SUMMARY OF THE INVENTION

The base of the ladder stand in accordance with the present invention is generally rectangular in shape having horizontal support tubes connected at the four corners, thereof. The base incorporates a pair of front legs and three (3) wheel sets, including a front wheel set located generally below the bottom step, a center set located below the center of the base, and a rear set located generally below the vertical rear legs. The rear wheel set is not used in the normal movement of the ladder stand, but assists, e.g., when the ladder stand is rolled over uneven terrain. The center wheel set is mounted on a pivoting cross tube extending from one side of the base to the other. The front wheel set below the bottom step can swivel in 360 degrees of motion along the plane of the ground, while the other two wheel sets are fixed to roll only in one direction (front to back).

The mobile ladder stand in accordance with this invention has two positions. First, when the rolling/locking mechanism is activated, the front and center wheel sets touch the ground and the front legs and rear wheel set are off the ground. Second, when the rolling/locking mechanism is deactivated, the front legs and the rear wheel set are touching the ground and the front and center wheel sets are off the ground.

This wheel set configuration gives the mobile ladder stand according to the present invention the ability to move only when using the center and front wheel sets. When it is desired to turn the mobile ladder stand around a corner, the user merely turns the corner in a normal manner. The mobile ladder stand pivots about the center wheels by using the swiveling front wheel set, enabling the user to turn the mobile ladder stand around tight corners (e.g., 90 degrees) using only approximately one-half the turning radius of a normal mobile ladder stand having just a rear wheel set under its vertical back legs and a front wheel set.

BRIEF DESCRIPTION OF THE DRAWINGS

FIG. 3 is a perspective view of the front wheel set with the wheels in the down or activated position.

FIG. 4 is a perspective view of the front wheel set with the wheels in the up or deactivated position.

FIG. 5 is a partial cross-sectional view of the wheel connection apparatus showing the front and center wheel sets in the down or activated position.

DETAILED DESCRIPTION OF THE DRAWINGS

Figure 1:
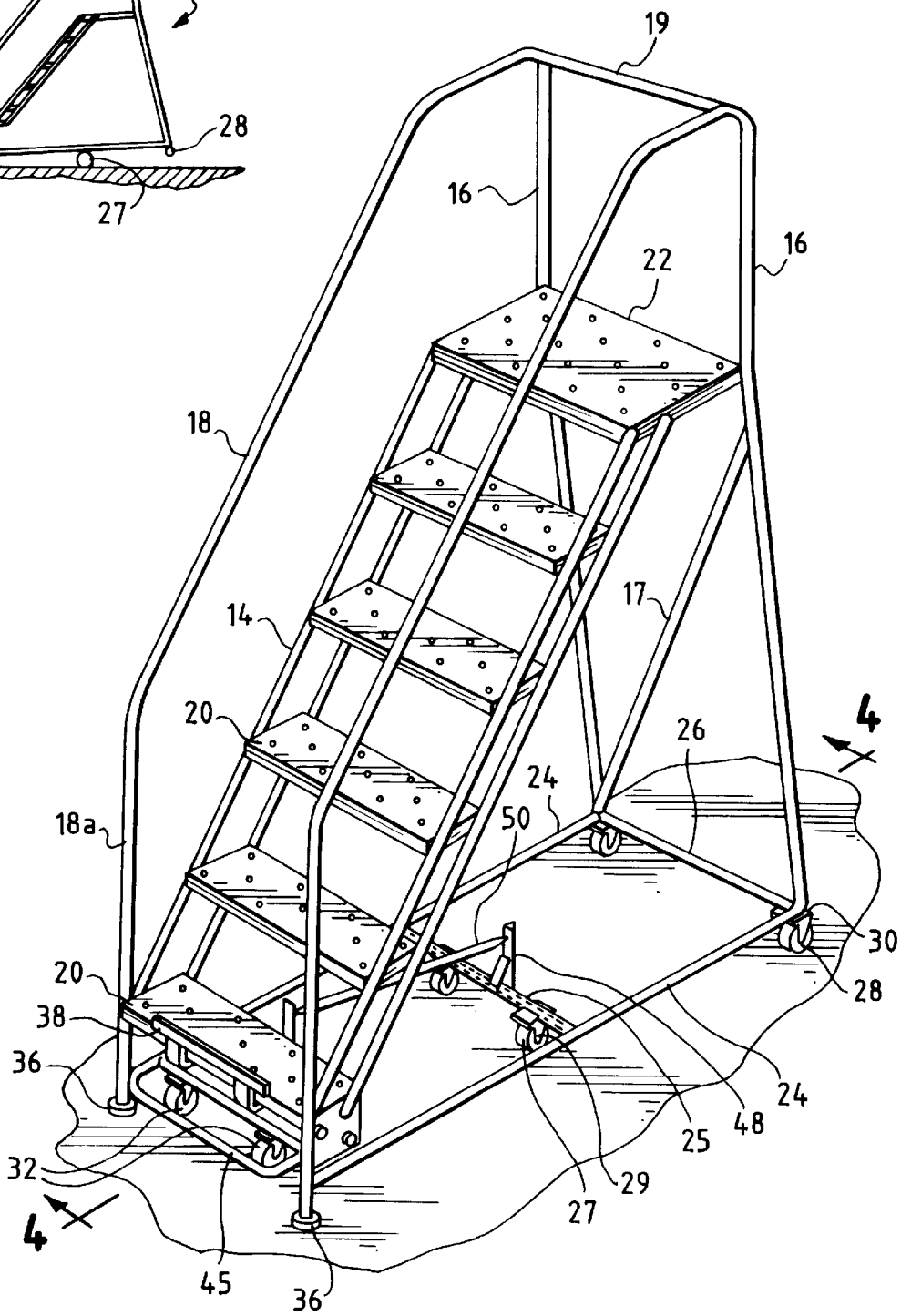
FIG. 1 is a perspective view of the ladder apparatus in accordance with the present invention.

As shown most clearly in FIG. 1, mobile ladder stand 10 incorporates a plurality of treads 20 terminating in a top tread 22 and supported by side straps 14 and vertical support beams 16. Hand rails 18, including front vertical members 18*a*, are formed for use by a person climbing the ladder and are secured at the top of mobile ladder stand 10 to vertical support beams 16 and top cross beam 19. An additional support member 17 may be provided for stability. The various beams and support elements of mobile ladder stand 10 may preferably be manufactured out of one-inch 16 gauge tubing which is standard in the industry. The design of the stair treads and the various support beams are not critical to this invention, as it may be used with many different types of mobile ladder stands or safety ladders.

The base of mobile ladder stand 10 includes longitudinal members 24 joined to lateral member 26 and base center beam 25. The base includes rear wheels 28 mounted on wheel housings 30, which are mounted on lateral member 26, and center wheels 27 mounted on housings 29 which are mounted on base center beam 25. The designs of the wheels and their respective housings are of a form known in the art. In the preferred embodiment of this design, the center wheel housings 29 and rear wheel housings 30 are fixed so that wheels 27 and 28, respectively, may rotate in the longitudinal direction of the base only.

As shown most clearly in FIGS. 3–9, front wheel set 32 are mounted in housings 33*a* on front cross beam 35. The diameter of center wheels 27 may be slightly larger than the diameter of front wheels and rear wheels. In one embodiment, center wheels 27 are five inches in diameter, while the front and rear wheels have a four inch diameter. However, mobile ladder stand 10 may also use identically-sized casters for all wheels. The arrangement of the wheels for either embodiment is such that the plane of the rear wheels is slightly above that of center wheels when the rolling/locking mechanism is activated. If casters of equal diameter are used for all wheel sets, the arrangements of the various axles will be modified to allow for the plane of the rear wheels to be slightly above that of center wheels during the activated mode.

Figure 2:
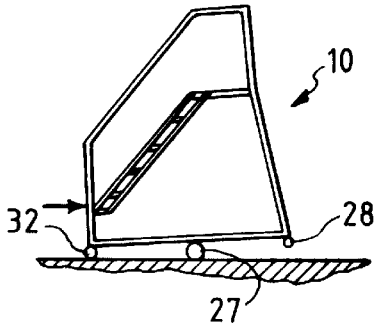
FIG. 2 is a side view of the safety ladder apparatus showing the center and front wheel sets in contact with the ground for movement of the ladder.

As set forth above, it is often necessary to easily move the entire ladder structure in different directions by turning the ladder. This turning is accomplished as shown in FIG. 2, where it can be seen that mobile ladder stand 10 can be rotated using front wheels 32 and center wheels 27 to give the mobile ladder stand a much tighter turning radius than such a known stand using front wheels 32 and rear wheels 28 for turning. Rear wheels 28 are, in fact, not used for moving the ladder and these casters could be replaced with solid feet. However, it is preferable to use casters because the mobile ladder stand will often be moved over rough terrain and rear wheels may run into foreign objects. The use of casters minimizes the risk that the ladder will be damaged by such contact by enabling it to roll over such obstacles.

Figure 6:
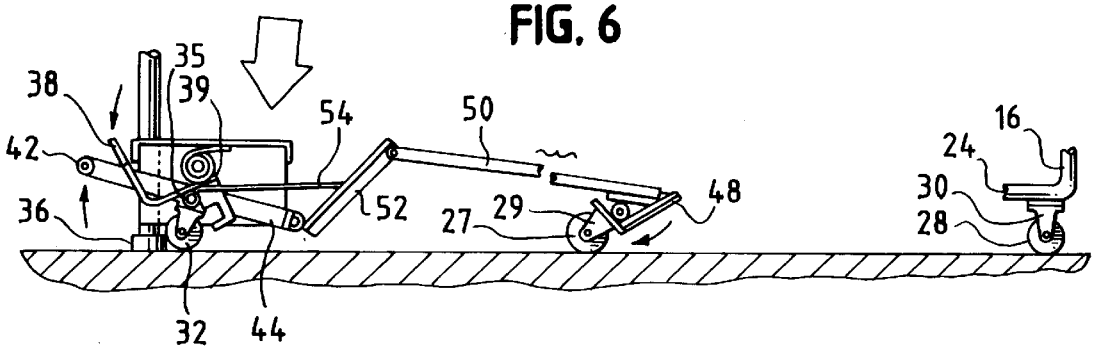
FIG. 6 is a partial cross-sectional view of the wheel connection apparatus showing the front and center wheel sets in the up or deactivated position.
Figure 8:
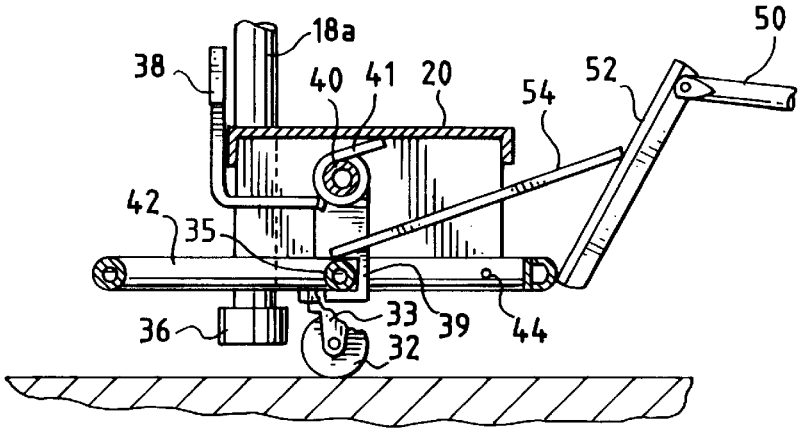
FIG. 8 is a detailed side cross-sectional view of the front wheel set as shown in FIG. 5.
Figure 9:
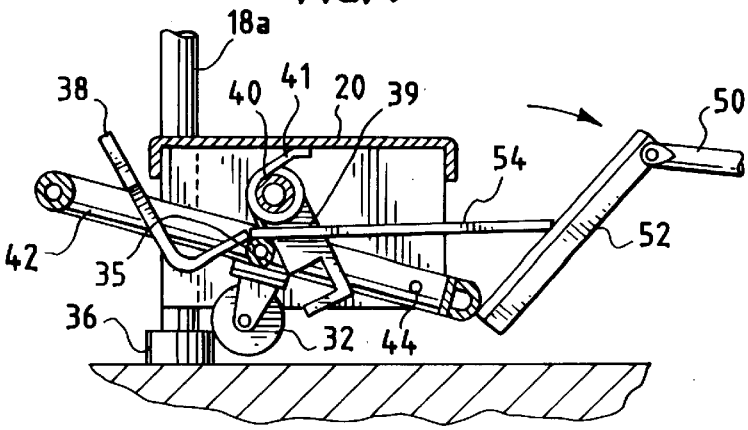
FIG. 9 is a detailed cross-sectional side view of the front wheel set as shown in FIG. 6.

As can be appreciated, one of the critical aspects of any safety ladder is the ability of the user to quickly secure the structure in one place while it is in use. Mobile ladder stand 10 includes footpads 36 mounted at the base of handrail front vertical members 18*a*. As can be seen most clearly in FIGS. 3–6, front wheels 32 and center wheels 27 have two positions, namely that they may be in the activated, or down, position, as shown in FIGS. 1, 3 and 5, wherein they may be used in the manner described above for longitudinal or rotational movement of mobile ladder stand 10. Front wheels 32 and center wheels 27 may also be in a deactivated, or raised, position as shown in FIGS. 4, 6 and 9, wherein footpads 36 and rear wheels 28 contact the ground to secure mobile ladder stand 10 in place for use.

Key to this invention is the use of a mechanical structure to allow the user to place both front wheels 32 and center wheels 27 in the raised position with a single movement. Specifically, FIG. 3 shows foot bar 38 rotationally mounted on upper cross bar 40 with springs 41. As discussed above, front wheel housings 33 are mounted in a conventional manner to rear cross beam 35, which is secured to the generally rectangular support 42. As shown in FIG. 6, support 42 may pivot about point 44. In the lowered position for front wheels 32, cross beam 35 is held in position by locking bracket 39 which is secured to upper cross bar 40 and may rotate therewith to the same extent as foot bar 38.

In operation, if a downward force is applied to foot bar 38 by, e.g. the application of pressure thereon as the user steps on first stair tread 20, the pressure exerted by foot pad 38 on springs 41 causes the partial rotation of upper cross bar 40, which in turn rotates locking bracket 39 to release front cross beam 35. This allows support 42 to pivot about point 44, lifting front wheels 32 slightly off the ground as footpads 36 are forced down to contact the ground surface.

For maximum stability of the ladder in use, the contact points with the ground are the two footpads 36 and the rear wheels 28. To ensure that these points are in contact with the ground, the present invention also provides a mechanism to move center wheels 27 and housings 29 slightly to compensate for the slightly larger diameters of center wheels 27 compared to the other sets of wheels, or, if all casters are the same size, to compensate for the fact that the plane of the center wheels is below the plane of the rear wheels. Center wheels 27 may be slightly off the ground and are in any event non-load bearing.

Figure 7:
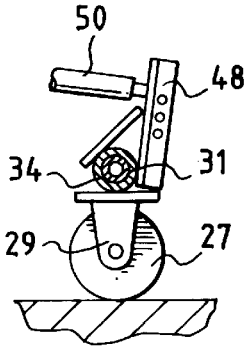
FIG. 7 is a cross-sectional view of the center beam mechanism and center wheel set of the present invention in the activated position.

This feature is accomplished through the operative connection of base center beam 25 to front wheel support 42. As shown in FIGS. 5, 6 and 7, center beam 25 actually consists of a two-piece structure. The inner piece 31 may be a one-inch 16 gauge tube welded to longitudinal members 24 which constitute the side of the base. There is also an outer section 34 which may consist of a 1-5/16 inch pipe rotatably mounted over inner tube 31, and all of the elements mounted on the center beam 25 are actually welded to outer pipe portion 34. This structure increases the strength and stability of the base while still allowing the center beam 25 to rotate. Wheel housings 29 are securely mounted on outer pipe 34 of rotatable base center beam 25, which also has a vertical member 48 securely attached thereto. Vertical member 48 is hingedly connected to one end of first beam 50, and the opposite end of first beam 50 is also hingedly connected to one end of second beam 52. The other end of second beam 52 is hingedly connected to front wheel support 42.

One end of pressure beam 54 is securely mounted to front cross beam 35 and the other end of pressure beam 54 is mounted to second beam 52. As is shown, the rotation of front cross beam 35 described above causes force to be transmitted along pressure beam 54 through second beam 52 to first beam 50 to push the top vertical member 48 rearward and down. This motion of vertical member 48 causes the partial rotation of outer pipe 34 of base center beam 25, also causing the movement of center wheels 27 from the upright, activated, position shown in FIGS. 1 and 5 to the collapsed, deactivated, position shown in FIG. 6, where center wheels 27 are above the plane of footpads 36 and rear wheels 28.

Thus, the simple motion of applying force to the first stair tread 20 or foot bar 38 automatically secures the position of mobile ladder stand 10 for maximum stability. It should be noted that the preferred embodiment set forth above describes a series of singular beams 48, 50, 52 and 54. It is to be understood that the functions of these elements could be carried out on a mobile ladder stand using more than one of each such element. For example, the outer pipe 34 could have two vertical members 48 secured thereto, with each such vertical member 48 having a corresponding set of beams operatively securing it to front cross beam 35. Mobile ladder stand 10 also cannot return to the activated position while in use. Therefore, there cannot be an accidental movement of the ladder while in use, increasing the safety of the structure.

When the user is finished climbing mobile ladder stand 10 and wishes to return it to its activated position as shown in FIG. 5, he merely needs to apply a downward pressure to bar 45 of support 42. This movement, and the force of springs 41, forces the return of each element to its original position in the reverse of the operation described above.

The above description is intended to set forth the preferred embodiment of this invention and is not intended to limit the invention in any way, and further equivalent embodiments will be obvious to one skilled in the art. This invention should be read as limited by the claims only.

We claim:

1. A ladder stand, comprising:

a unitary base having a front and rear end and at least six wheels;

a plurality of stair treads extending upward from said base and supported thereon;

a retractable first pair of wheels mounted proximate to the front end of said base;

a retractable second pair of wheels mounted to said base approximately midway between said front end and said rear end of said base;

a third pair of wheels mounted proximate to the rear end of said base;

a foot bar mounted on said base; and a link connecting said foot bar to said retractable first and second pair of wheels set whereby pressure applied to said foot bar results in a retraction of said retractable first and second pair of wheels.

2. The ladder stand as recited in claim 1, wherein retractable second pair of wheels has a larger diameter than said first pair of wheels such that said ladder stand may be tilted away from vertical when said retractable second pair of wheels is in an unretracted position.

3. The ladder stand as recited in claim 1, further comprising a means for maintaining said retractable second pair of wheels in a retracted position.

4. The ladder stand as recited in claim 3, further comprising a means for releasing said retractable second pair of wheels position.

5. The ladder stand as recited in claim 1, further comprising a pair of footpads mounted proximate to the rear end of said base.

6. The ladder stand as recited in claim 1, wherein said first wheel set is rotatable in all directions in the plane of said base and the retractable second pair of wheels is locked in position.

7. The ladder stand as recited in claim 1, wherein said foot bar is located proximate to a lowest one of said plurality of stair treads.

* * * * *